US007994925B2

(12) United States Patent
Lahiri

(10) Patent No.: US 7,994,925 B2
(45) Date of Patent: Aug. 9, 2011

(54) MONITORING ACCESS TO CONTROLLED AREAS USING ELECTRONIC MONITORS

(75) Inventor: Sandip Lahiri, Tampa, FL (US)

(73) Assignee: International Business Machines Corporation, Armonk, NY (US)

( * ) Notice: Subject to any disclaimer, the term of this patent is extended or adjusted under 35 U.S.C. 154(b) by 615 days.

(21) Appl. No.: 11/967,157

(22) Filed: Dec. 29, 2007

(65) Prior Publication Data

US 2009/0165511 A1 Jul. 2, 2009

(51) Int. Cl.

| | |
|---|---|
| ***G08B 13/14*** | (2006.01) |
| *E05B 45/06* | (2006.01) |
| *E05B 15/00* | (2006.01) |
| *G08B 13/08* | (2006.01) |

(52) U.S. Cl. .... 340/572.8; 70/266; 340/542; 340/545.1; 340/545.8

(58) Field of Classification Search ..... 340/572.8, 340/542; 70/266

See application file for complete search history.

(56) References Cited

U.S. PATENT DOCUMENTS

| | | | | |
|---|---|---|---|---|
| 2004/0090327 | A1 * | 5/2004 | Soloway et al. | 340/545.1 |
| 2007/0214848 | A1 * | 9/2007 | Meyerle et al. | 70/278.2 |
| 2007/0289012 | A1 * | 12/2007 | Baird | 726/17 |
| 2008/0143524 | A1 * | 6/2008 | Marusak et al. | 340/545.8 |
| 2008/0186173 | A1 * | 8/2008 | Gates | 340/542 |
| 2009/0027194 | A1 * | 1/2009 | McGrath | 340/540 |
| 2009/0164787 | A1 * | 6/2009 | Haberli et al. | 713/173 |

* cited by examiner

*Primary Examiner* — George A Bugg
*Assistant Examiner* — Jack Wang
(74) *Attorney, Agent, or Firm* — Steven M. Greenberg, Esq.; Carey, Rodriguez, Greenberg & Paul

(57) ABSTRACT

The present invention addresses deficiencies of the art in respect to commercial asset control and provides a novel and non-obvious system and device for monitoring access to controlled areas. In one embodiment of the invention, the device can include a securing mechanism having an open state and a closed state. The device can further include a housing coupled with the securing mechanism, the housing comprising a radio frequency-opaque material, wherein the housing completely encloses a volume when the securing mechanism is in the closed state and wherein the housing includes an opening when the securing mechanism is in the open state. The device can further include an electronic marker located inside the volume of the housing, wherein the electronic marker periodically emits a signal.

20 Claims, 3 Drawing Sheets

MONITORING ACCESS TO CONTROLLED AREAS USING ELECTRONIC MONITORS

BACKGROUND OF THE INVENTION

1. Field of the Invention

The present invention relates to commercial asset control, and more particularly to monitoring access to controlled areas for the purpose of asset control.

2. Description of the Related Art

Asset control is a critical capability required in numerous business environments. Assets may comprise computer parts or products, electronics, jewelry, works of art, airport baggage, hospital items, confidential records, or any other merchandise or products. One approach to the problem of asset control is the monitoring of access to controlled areas that contain the assets. Controlled areas may include an enclosed computer cabinet, a shipping container, a room, a building, an area, a group of rooms or buildings or a section of an area. Monitoring access to the areas containing the assets provides a level of control over possession of the assets.

One proposed solution to this problem involves the use of a secured entry system that comprises a detector or a computer interface located at the entryway of the controlled area, as well as a computer system for processing. In a typical secured entry system, a user presents an electronic passkey or transmitter at the entryway and the system checks whether the user possesses permission to access the controlled area. A secured entry system may further include monitoring of movement of assets into and out of the controlled area. Although successful in many ways, the aforementioned secured entry system can be expensive and time consuming to install and administer. The installation of an entryway detector and a system server is required, as well as the distribution of passkeys and the corresponding server programming of permissions. Finally, the system must be maintained by a computer administrator and periodically checked. Thus, the proposed solution may be beyond the budget of small businesses and individuals.

Presently there is no known way to rapidly deploy an inexpensive and easily maintainable system or mechanism for monitoring access to controlled areas. Thus, in light of the prior art, there currently is a need for a more efficient way of monitoring access to controlled areas containing valuable assets.

BRIEF SUMMARY OF THE INVENTION

Embodiments of the present invention address deficiencies of the art in respect to commercial asset control and provide a novel and non-obvious system and device for monitoring access to assets. In one embodiment of the invention, a device for monitoring access to a controlled area is disclosed. The device can include a securing mechanism having an open state and a closed state. The device can further include a housing coupled with the securing mechanism, the housing comprising a radio frequency-opaque material, wherein the housing completely encloses a volume when the securing mechanism is in the closed state and wherein the housing includes an opening when the securing mechanism is in the open state. The device can further include an electronic marker located inside the volume of the housing, wherein the electronic marker periodically emits a signal.

In another embodiment of the invention, device for monitoring access to a controlled area is disclosed. The device includes a securing mechanism having an open state and a closed state and an electronic marker coupled with the securing mechanism. The device further includes a switch for a battery of the electronic marker, wherein the switch opens a circuit when the securing mechanism is in the closed state and wherein the switch completes a circuit when the securing mechanism is in the open state, thereby enabling the electronic marker to emit a signal periodically.

In yet another embodiment of the invention, a system for monitoring access to a controlled area can be provided. The system can include a securing mechanism having a open state and a closed state. The system can further include a housing coupled with the securing mechanism, the housing comprising a radio frequency-opaque material, wherein the housing completely encloses a volume when the securing mechanism is in the closed state and wherein the housing includes an opening when the securing mechanism is in the open state. The system can further include an electronic marker located inside the volume of the housing, wherein the electronic marker periodically emits a signal. The system can further include a receiver for receiving a signal from the electronic marker and logging metadata about the signal.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the present invention provide a system and device for monitoring access to controlled areas containing valuable assets. In accordance with an embodiment of the present invention, a device for monitoring access to a controlled area is disclosed. The device can include a lock coupled with a housing comprising a radio frequency-opaque material such as a metallic conductor. The housing completely encloses a volume when the lock is closed and the housing includes an opening when the lock is open. An RFID tag within the housing periodically emits an RF signal that travels outside the housing when the lock is open. The RF signal does not travel outside the housing when the lock is closed. A detector detects the RF signal when it travels outside the housing and logs the event.

In another embodiment of the invention, the device includes a lock with an RFID tag coupled with the lock. The device further includes a battery switch for the RFID tag, wherein the switch opens the circuit when the lock is closed and wherein the switch closes the circuit when the lock is open, thereby enabling the electronic marker to emit a signal periodically.

Figure 1:
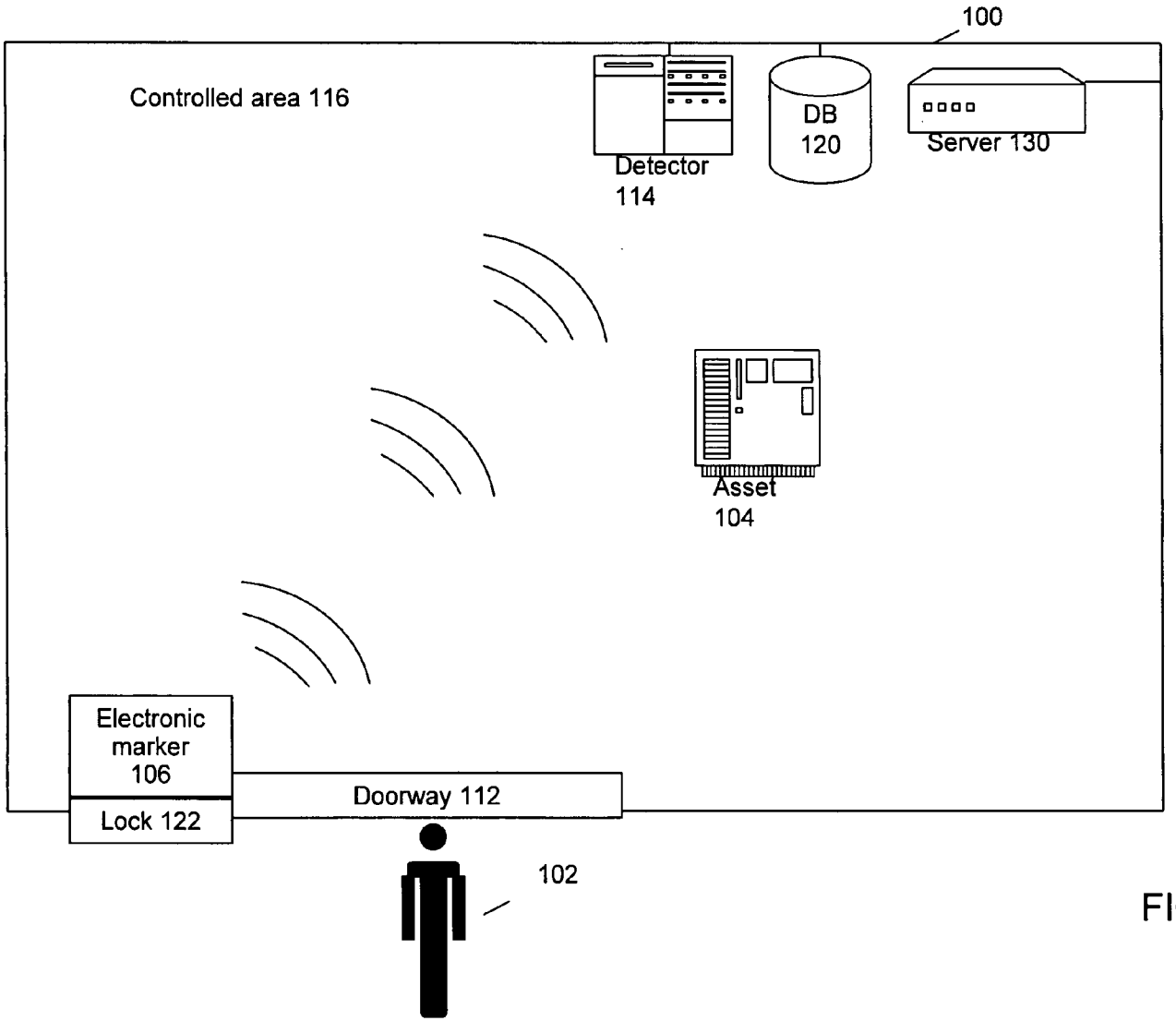
FIG. 1 is a block diagram illustrating the various components of a controlled area monitoring system, in accordance with one embodiment of the present invention.

FIG. 1 is a block diagram illustrating the various components of a controlled area monitoring system 100, in accordance with one embodiment of the present invention. FIG. 1 shows a controlled area 116 that may comprise a shipping container, a room, a building, a computer cabinet, an area, a group of rooms or buildings or a section of an area. Inside controlled area 116 is an asset 104, which may be any product that is sought to be controlled such as computer parts, electronic parts or products, jewelry, works of art, airport baggage, hospital or clinic items, records, or any other merchandise or products. The controlled area monitoring system 100 monitors access to the controlled area 116.

FIG. 1 further shows an individual 102, such as an employee attempting to gain access to controlled area 116 via door or doorway 112. The doorway or door 112 comprises a method of ingress and/or egress to and from the controlled area 116 and may comprise a sliding door, a revolving door, a pair of cabinet doors, a turnstile or the like. The door or doorway 112 is secured using a lock 122 as a securing mechanism to secure a door to a doorframe or threshold. An electronic marker 106 is coupled to the lock 122. Electronic marker 106 may be a Radio Frequency Identification (RFID) tag, magneto acoustic marker, a magnetic stripe card, a smart card or any other item that can be read by interfacing with the item, scanning the item or by reading of identifying data emitted by the item.

FIG. 1 further shows a detector 114 located opposite a doorway or door 112. The detector 114 comprises a receiver unit that reads radio frequency or magnetic emissions to identify information from the electronic marker 106. When an employee 102 opens the door 112, the lock 122 is placed in an open state. As a result, the electronic marker 106 coupled to or within the lock 122 emits an RF signal that may contain a unique identifier, a time, a date and/or a coded message. The RF signal is captured by detector 114, which logs the event for later scrutiny by an administrator or security personnel.

Also shown in FIG. 1 is an optional server 130 that logs the information captured by the scanner 114. The server 130 comprises a computer or group of computers that are coupled, such as via a network, with the detector 114. When an employee 102 opens the door 112, the lock 122 is placed in an open state. As a result, the electronic marker 106 coupled to or within the lock 122 emits an RF signal that may contain a unique identifier, a time, a date and/or a coded message. The RF signal is captured by detector 114, which subsequently sends the data garnered from the electronic marker 106 to the server 130. The server 130 then stores the data, and possibly additional data (such as a confirmed date and time) in the database 120, for later scrutiny by an administrator or security personnel. Alternatively, the server 130 may order that a notice, such as an email, be sent to an individual, such as a manager or security personnel, via the network.

Figure 2:
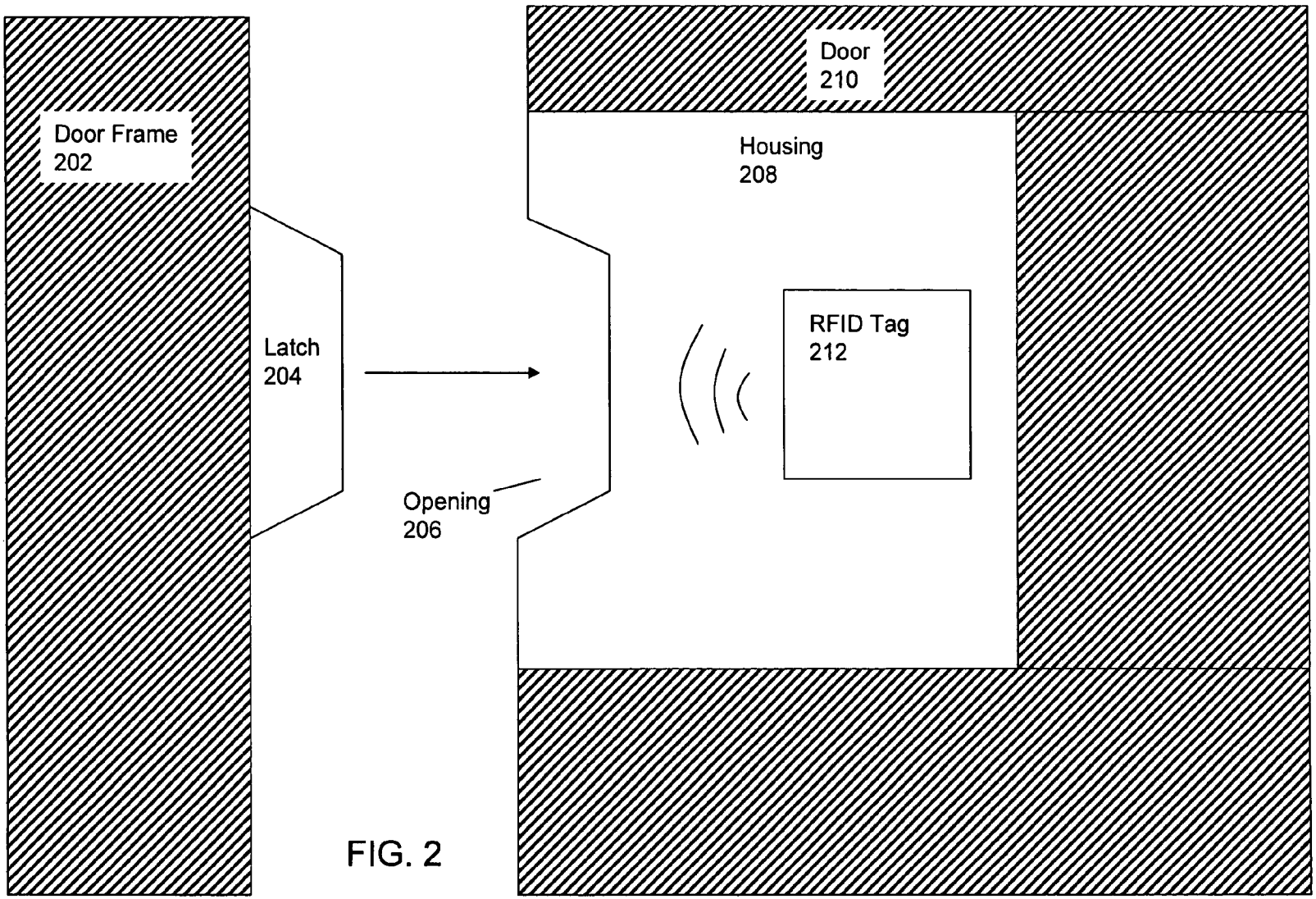
FIG. 2 is an illustration of a device used for monitoring access to a controlled area, according to one embodiment of the present invention.

FIG. 2 is an illustration of a device used for monitoring access to a controlled area 116, according to one embodiment of the present invention. FIG. 2 shows a door 210 corresponding to door or doorway 112 of FIG. 1. FIG. further shows a door frame or threshold 202 in which the door 210 fits when closed. Embedded in door 210 is a housing 208 comprised of RF-opaque material such as a conductive metallic material, an insulator or a dielectric. An RF-opaque material is a medium that greatly dampens or completely stops the propagation of RF signals.

When the door 210 is opened and not in contact with the door frame 202, the housing 208 has an exposed opening 206. When the door 210 is closed and in contact with door frame 202, a latch 204 on door frame 202 covers or plugs the opening 206. The latch 204 may be a bolt, a hinged door, a moving element with a hook-end, a protruding element matching the dimensions of opening 206 or any other element that covers or plugs the opening 206. The latch 204 may further be constructed from the same RF-opaque material from which the housing 208 is constructed. In an embodiment of the present invention, the latch 204 comprises a portion of a locking mechanism that secures door 210 to door frame 202. Note that lock 122 of FIG. 1 corresponds to latch 204 and housing 208.

Located within the housing 208 is an RFID tag 212, which emits an RF signal on a periodic basis, such as every second. The RF signal may contain a unique identifier, a time, a date and/or a coded message. When the door 210 is opened and not in contact with the door frame 202, the RF signal escapes from the housing 208 through the exposed opening 206. When the door 210 is closed and in contact with the door frame 202, the RF signal cannot escape from the housing 208 because the opening 206 is covered by latch 204.

Figure 3:
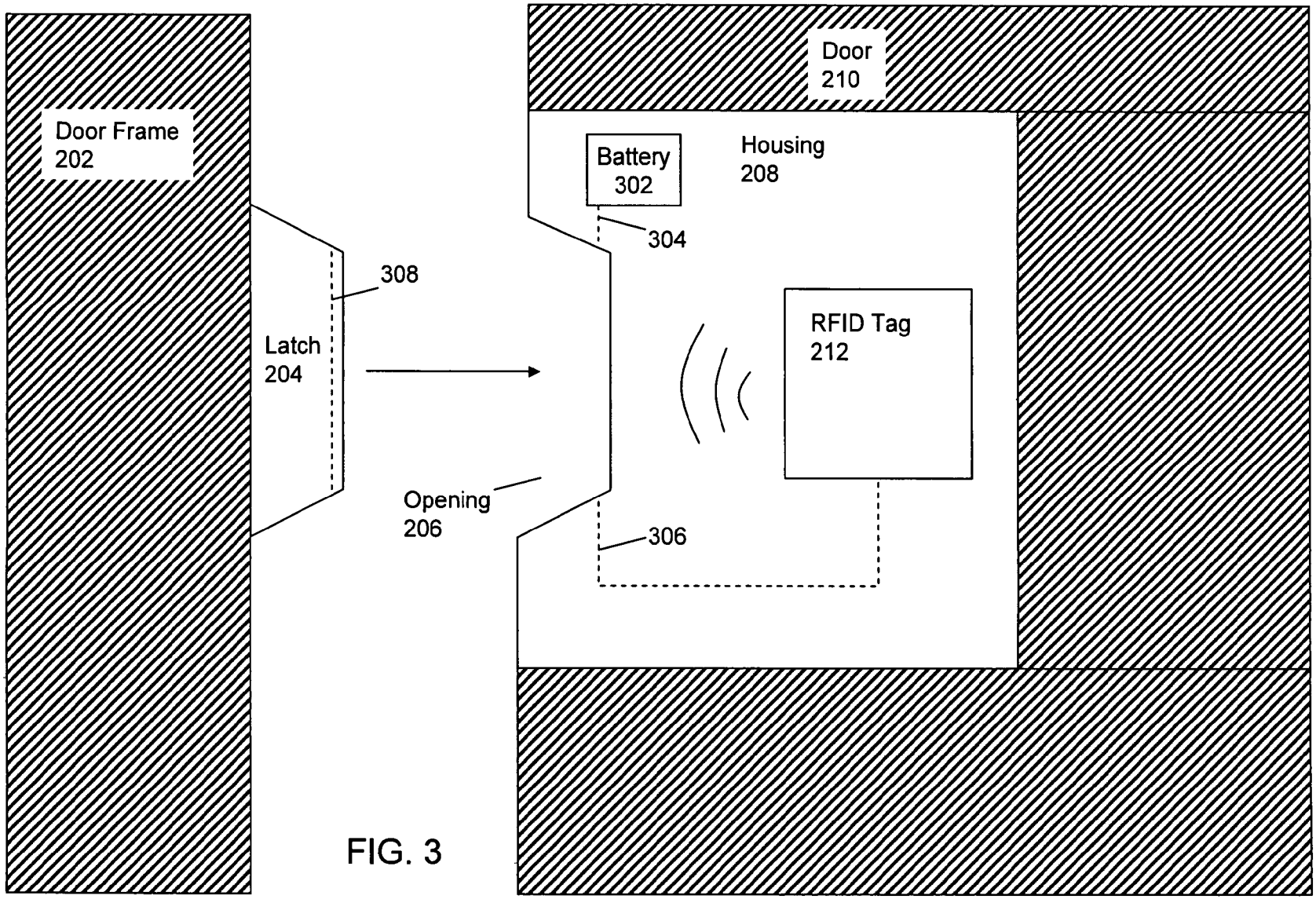
FIG. 3 is an illustration of another device used for monitoring access to a controlled area, according to another embodiment of the present invention.

FIG. 3 is an illustration of another device used for monitoring access to a controlled area 116, according to another embodiment of the present invention. FIG. 3 shows the door 210, door frame or threshold 202, housing 208, RFID tag 212, latch 204, and opening 206 of FIG. 2.

FIG. 3 also shows a battery 302 that provides power to the RFID tag 212 through a conductor that begins with portion 304, continues with portion 308 on latch 204, and ends with portion 306. When the door 210 is opened and not in contact with the door frame 202, the portion 308 on latch 204 is separated from the RFID tag 212 and therefore the circuit that provides battery power to the RFID tag 212 is open. When power is not provided to the RFID tag 212, no RF signal is emitted. When the door 210 is closed and in contact with door frame 202, the latch 204 on door frame 202 is inserted into the opening 206, the portion 308 on latch 204 contacts portion 304 and portion 206 and therefore the circuit that provides battery power to the RFID tag 212 is closed.

When power is provided to the RFID tag 212, an RF signal is emitted on a periodic basis, such as every second. The RF signal may contain a unique identifier, a time, a date and/or a coded message.

Embodiments of the invention can take the form of an entirely hardware embodiment, or an embodiment containing both hardware and software elements. In a preferred embodiment, the invention is implemented using hardware and software, which includes but is not limited to firmware, resident software, microcode, and the like. Furthermore, at least a portion of the invention can take the form of a computer program product accessible from a computer-usable or computer-readable medium providing program code for use by or in connection with a computer or any instruction execution system.

For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution. Input/output or I/O devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters.

I claim:

1. A device for monitoring access to a controlled area, comprising:

a securing mechanism having a open state and a closed state;

a housing coupled with the securing mechanism, the housing comprising a radio frequency-opaque material, wherein the housing completely encloses a volume when the securing mechanism is in the closed state and wherein the housing includes an opening when the securing mechanism is in the open state; and an electronic marker located inside the volume of the housing, wherein the electronic marker periodically emits a signal.

2. The device of claim 1, wherein the securing mechanism is configured to secure a first element to a second element when the securing mechanism is in the closed state.

3. The device of claim 2, wherein the securing mechanism comprises a latch that secures the first element to the second element when the securing mechanism is in the closed state.

4. The device of claim 3, wherein the securing mechanism comprises a lock.

5. The device of claim 2, wherein the housing comprises a portion that is removed from a main body of the housing when the securing mechanism is in the open state.

6. The device of claim 5, wherein the housing comprises a metallic material.

7. The device of claim 5, wherein the electronic marker is an RFID tag.

8. A device for monitoring access to a controlled area, comprising:

a securing mechanism having a open state and a closed state;

an electronic marker coupled with the securing mechanism; and a switch for a battery of the electronic marker, wherein the switch opens a circuit when the securing mechanism is in the closed state and wherein the switch completes a circuit when the securing mechanism is in the open state, thereby enabling the electronic marker to emit a signal periodically.

9. The device of claim 8, wherein the securing mechanism is configured to secure a first element to a second element when the securing mechanism is in the closed state.

10. The device of claim 9, wherein the securing mechanism comprises a latch that secures the first element to the second element when the securing mechanism is in the closed state.

11. The device of claim 10, wherein the securing mechanism comprises a lock.

12. The device of claim 10, wherein the switch comprises the latch closing the circuit when the securing mechanism is in the open state and the latch opening the circuit when the securing mechanism is in the closed state.

13. The device of claim 12, wherein the electronic marker is an RFID tag.

14. A system for monitoring access to a controlled area, comprising:

a securing mechanism having a open state and a closed state;

a housing coupled with the securing mechanism, the housing comprising a radio frequency-opaque material, wherein the housing completely encloses a volume when the securing mechanism is in the closed state and wherein the housing includes an opening when the securing mechanism is in the open state;

an electronic marker located inside the volume of the housing, wherein the electronic marker periodically emits a signal; and a receiver for receiving a signal from the electronic marker and logging metadata about the signal.

15. The system of claim 14, wherein the securing mechanism is configured to secure a first element to a second element when the securing mechanism is in the closed state.

16. The system of claim 15, wherein the securing mechanism comprises a latch that secures the first element to the second element when the securing mechanism is in the closed state.

17. The system of claim 16, wherein the securing mechanism comprises a lock.

18. The system of claim 15, wherein the housing comprises a metallic material.

19. The system of claim 15, wherein the electronic marker is an RFID tag.

20. The system of claim 19, wherein the receiver further comprises a memory storage device for storing a date and time that the signal from the electronic marker was received.

* * * * *